US007535428B2

(12) United States Patent
Koslover

(10) Patent No.: US 7,535,428 B2
(45) Date of Patent: May 19, 2009

(54) FLAT-APERTURE WAVEGUIDE SIDEWALL-EMITTING TWIST-REFLECTOR ANTENNA

(76) Inventor: Robert A. Koslover, 2726 Rockbridge Rd., Tyler, TX (US) 75701

( * ) Notice: Subject to any disclaimer, the term of this patent is extended or adjusted under 35 U.S.C. 154(b) by 539 days.

(21) Appl. No.: 11/436,318

(22) Filed: May 18, 2006

(65) Prior Publication Data

US 2008/0231533 A1 Sep. 25, 2008

Related U.S. Application Data

(60) Provisional application No. 60/695,779, filed on Jun. 30, 2005.

(51) Int. Cl.
*H01Q 13/00* (2006.01)
*H01Q 3/00* (2006.01)
*H01P 1/161* (2006.01)

(52) U.S. Cl. ..... 343/762; 333/21 A; 343/781 P

(58) Field of Classification Search ..... 333/21 A; 343/781 R, 781 P, 783, 775, 772, 762
See application file for complete search history.

(56) References Cited

U.S. PATENT DOCUMENTS

| | | | | |
|---|---|---|---|---|
| 5,565,879 | A * | 10/1996 | Lamensdorf | 343/781 R |
| 5,943,023 | A * | 8/1999 | Sanford | 343/772 |
| 6,014,108 | A * | 1/2000 | Lynch et al. | 343/753 |
| 6,307,522 | B1 * | 10/2001 | Alexanian | 343/781 CA |
| 6,559,807 | B2 * | 5/2003 | Koslover | 343/781 P |

* cited by examiner

*Primary Examiner*—Seungsook Ham
*Assistant Examiner*—Kyana R Robinson
(74) *Attorney, Agent, or Firm*—Stetina Brunda Garred & Brucker

(57) ABSTRACT

A flat aperture waveguide sidewall-emitting twist-reflector (FAWSET) antenna, having an E-plane sectoral flare having a depth merely the H-plane width of the waveguide. Extending the E-plane sectoral flare is a twist-reflector tilted from one sidewall of the E-plane flare and a trans-reflector extending from another opposing sidewall of the E-plane flare. An angle between distal end of the twist-reflector and the trans-reflector is a function of the frequency of the incoming wave.

2 Claims, 6 Drawing Sheets

FLAT-APERTURE WAVEGUIDE SIDEWALL-EMITTING TWIST-REFLECTOR ANTENNA

CROSS-REFERENCE TO RELATED APPLICATIONS

The present application claims priority to Provisional Patent Application Ser. No. 60/695,779, filed Jun. 30, 2005, entitled FLAT-APERTURE WAVEGUIDE SIDEWALL-EMITTING TWIST-REFLECTOR ANTENNA.

STATEMENT RE: FEDERALLY SPONSORED RESEARCH/DEVELOPMENT

This invention was made with Government support under Contract No. F29601-03-M-0182 awarded by the United States Air Force. The Government has certain rights in the invention.

BACKGROUND

The present invention relates in general to a flat aperture waveguide sidewall-emitting twist-reflector antenna.

BRIEF SUMMARY

A flat aperture waveguide sidewall-emitting twist-reflector (FAWSET) antenna is provided. The FAWSET antenna includes an E-plane sectoral flare having a depth merely the H-plane width of the waveguide. Extending from the E-plane sectoral flare includes a twist-reflector tilted from one sidewall of the E-plane flare and a trans-reflector extending from another opposing sidewall of the E-plane flare. An angle between distal end of the twist-reflector and the trans-reflector is a function of the frequency of the incoming wave.

The direction of the incoming wave is also defined based on the frequency thereof. More specifically, the propagation direction of the incoming wave is so selected that when the $TE_{10}$ mode of the incoming wave is incident on the sidewalls of the E-plane sectoral flare, such $TE_{10}$ mode will be reflected with an angle of ($\phi=\sin^{-1}(f_c/f)$ relative to the sidewalls. Therefore, when the $TE_{10}$ mode reflected off from the sidewalls arrives at the twist-reflector, a twist-reflected output wave can be resulted and transmit through the trans-reflector. However, when the $TE_{10}$ mode impinges the trans-reflector before approaching the twist-reflector, the trans-reflector will reflect the $TE_{10}$ mode towards the twist-reflector to result in a twist-reflected output wave.

In one embodiment, the flat aperture waveguide sidewall-emitting twist-reflector antenna can be modified with a cylindrical configuration. In the cylindrical version of the FAWSET antenna, three E-plane waveguides are equidistantly distributed along a circle. Each of the E-plane waveguides provides a rectangular cross section for guiding the incident E-wave. These three E-plane waveguides gradually broaden along the circle to eventually merge as a hollow cylinder. The hollow cylinder is then encircled by a plurality of loops of wire, forming a trans-reflector. A full 360° azimuthally continuous input $E_\phi$ is required to feed the antenna to result in axially. polarized E-wave output.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
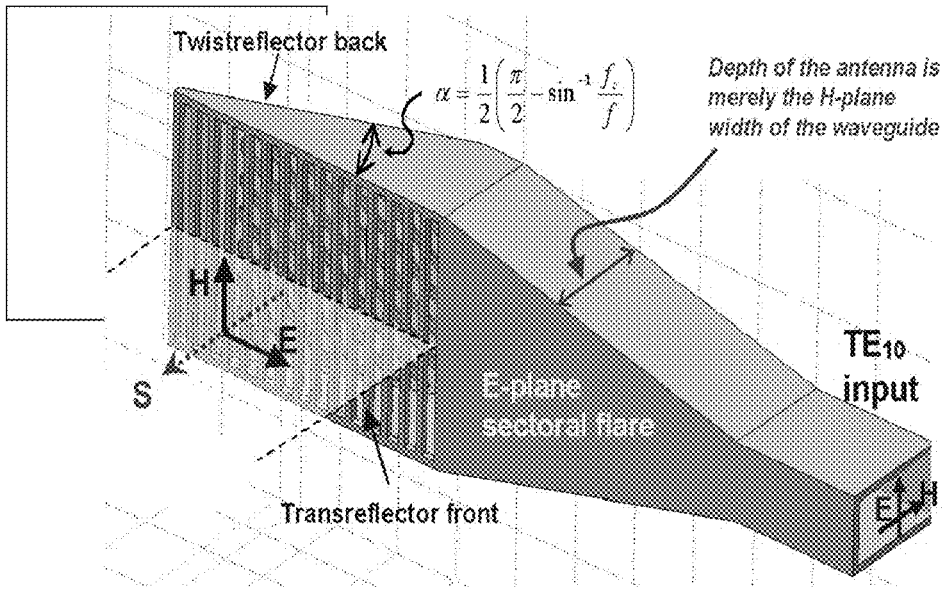
FIG. 1 shows a flat aperture waveguide sidewall-emitting twist-reflector antenna.

FIG. 1 illustrates a flat-aperture waveguide sidewall-emitting twist-reflector (FAWSET) antenna which is a compact low-profile geometry antenna suitable for use in an airborne platform and capable of radiating extremely high power microwave (HPM) pulses. The flat-aperture waveguide sidewall-emitting twist-reflector antenna is particularly applicable to radiation of high-power because of its relatively large aperture which distributes the power evenly over a large aperture area; thus reducing the risk of microwave-induced air-breakdown at the aperture. As shown, the interior of the FAWSET antenna is normally evacuated to high-vacuum during operation of high-power microwave pulses. The aperture is covered by a dielectric window to provide vacuum-to-air seal.

The conveyance of the input microwave power from a standard-size rectangular waveguide to such a large aperture, in a low-profile package, is not practical with more conventional means, such as pyramidal horns. This is because serious phase-front distortion (phase error) and wave-reflection will occur if such a horn is made too short. In contrast, a low-profile (i.e., small depth) antenna becomes possible by the novel employment of a transreflector and twistreflector integrated into the waveguide, in a configuration that reflects the power around a 90-degree bend, while simultaneously expanding the aperture beyond that which would be possible with a conventional waveguide bend that did not employ a trans-reflector/twist-reflector combination.

Figure 2:
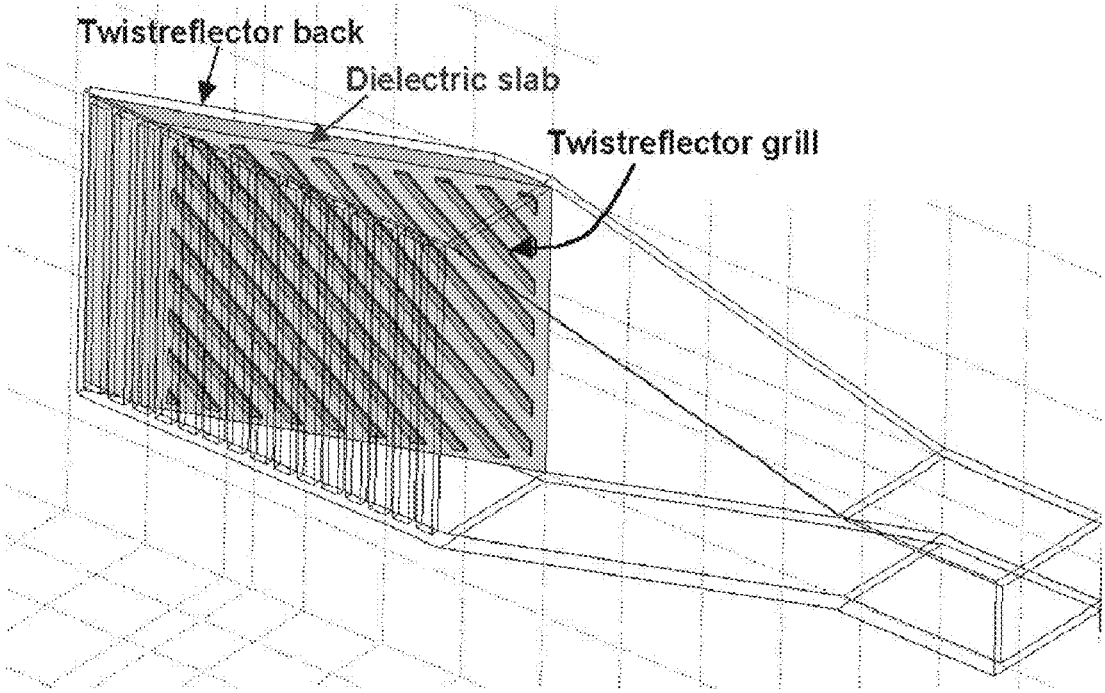
FIG. 2 shows the interior structure of the flat aperture waveguide sidewall-emitting twist-reflector antenna as shown in FIG. 1.

FIG. 2 shows an interior structure of the FAWSET antenna as shown in FIG. 1. As shown, the twist-reflector of the FAWSET antenna rotates the polarization of the incident $TE_{10}$ waveguide mode by 90° and reflects it outward through the trans-reflector.

To yield output radiation normal to the trans-reflector face, that is, normal to the aperture, the tilt angle $\alpha$ of the twist-reflector is not $\pi/4$. This is because the incident $TE_{10}$ wave is not a free-space mode, which is a crucial fact for providing the advantages offered by the FAWSET antenna as explained below.

Figure 3:
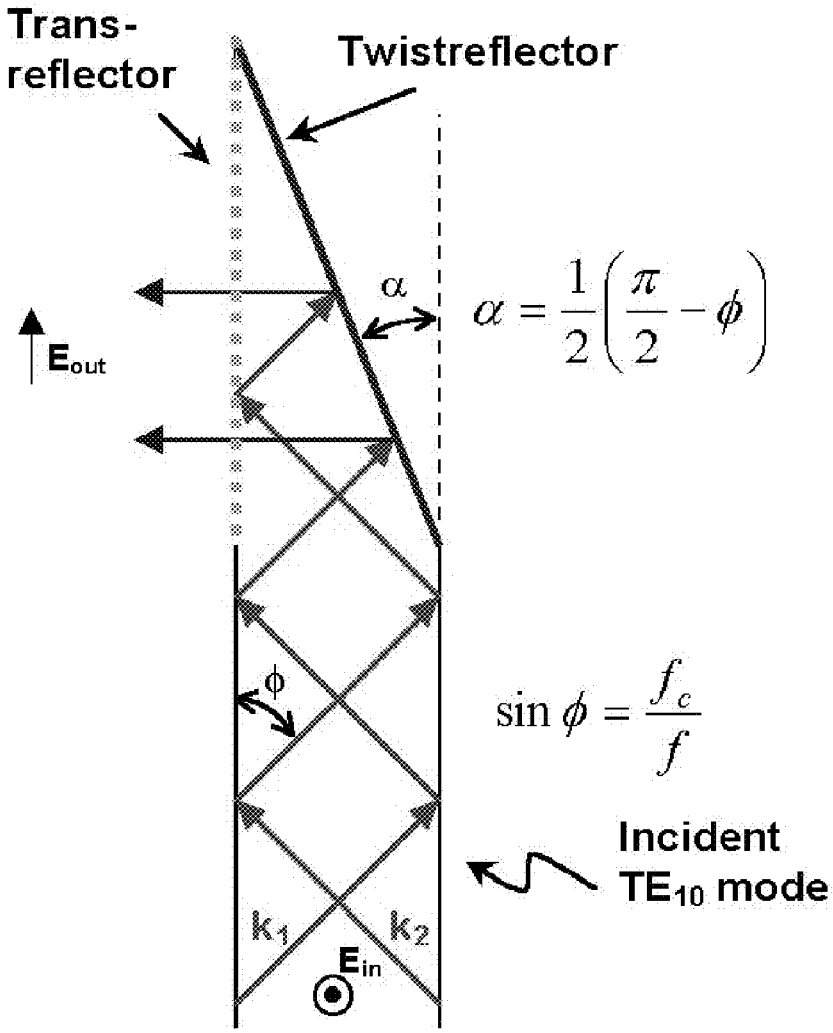
FIG. 3 shows the propagation path of the $TE_{10}$ mode within the antenna as shown in FIG. 1.

The $TE_{10}$ phase velocity can be expressed as:

$$v_{ph}=c/\sqrt{1-(f_c/f)^2} \tag{1}$$

where $f_c$ is the cutoff frequency. To simplify the geometric interpretation, the two-layer twist-reflector is replaced by an idealized thin-surface twist-reflector as shown in FIG. 3. The $TE_{10}$ mode can be treated of as a superposition of two unbounded plane waves reflecting off the sidewalls of the waveguide with a reflection angle $\phi$ relative to the sidewalls. Although each wave travels with the speed c, it travels with a zig-zag path. Therefore, when viewed boresight along the waveguide, the in-guide phase velocity becomes:

$$v_{ph}=c/\cos\phi \quad (2),$$

or $$v_{ph}=c/\sqrt{1-\sin^2\phi} \quad (3).$$

Comparing this to the expression of $v_{ph}$ in Equation (1), it follows that $$\sin\phi=f_c/f \quad (4).$$

Considering f=1.3 GHz in WR-650 waveguide of which the cutoff frequency $f_c$ is 0.9079 GHz, the phase $\phi$ can be computed as 44.30°; and thus, the tilt angle $\alpha$ can be derived as 22.85°, which is just over $\pi/8$. It appears that the tilt angle $\alpha$ is much less than 45° ($\pi/4$). Based on this effect, a long aperture ($l\propto 1/\tan\alpha$) can be obtained in such a flat package.

In FIG. 3, the twist-reflector is shown oriented at an. angle $\alpha$ so that the output wave will have its k vector normal to the sidewalls, of which the latter part is replaced by a trans-reflector as shown in FIGS. 1 and 3. The trans-reflector also plays an essential role in this process by providing the wall needed to preserve the $TE_{10}$ mode as the incident wave illuminates the twist-reflector along its path, yet offers a very-nearly transparent opening to the outgoing wave, that is, the twist-reflected wave. More specifically, when the $TE_{10}$ mode is incident on the trans-reflector before impinging on the twist-reflector, the $TE_{10}$ mode is reflected from the trans-reflector in the same manner as the $TE_{10}$ mode incident on the sidewalls of the waveguide. In contrast, once the $TE_{10}$ mode is reflected by the twist-reflector into the twist-reflected wave, as the trans-reflector is nearly transparent to the twisted-reflected wave, the twisted-reflected wave can thus propagate through the trans-reflector as an output wave of the antenna. The trans-reflection feature of the trans-reflector is realized by using the polarization-transforming/manipulating surfaces. The twist-reflected output wave also propagates inside the aperture-part of the waveguide, however, the effective width of the waveguide for this polarization-rotated mode is given by the vertical dimension, which because of the flare that has been introduced, is much larger than the original (feed) waveguide width for the input $TE_{10}$ mode. As such, the new cutoff frequency for the output wave is actually much lower than $f_c$ for the original input $TE_{10}$ wave. For a large enough flare, the output wave will thus propagate with $v_{ph}\sim c$ even within the waveguide.

Because the angle $\phi$ is a function of frequency, the antenna can be frequency steered, subject to the bandwidth of the twist-reflector. Alternatively, for a fixed-frequency HPM source, the tile angle $\alpha$ can be chosen during the design process to set the angle of the output radiation to any preferred direction with reasonable limits in the plane. Referring to FIG. 3, any frequency f higher than the normal frequency $f_{normal}$ will be radiated in an upward-inclined direction, while any frequency f lower than the normal frequency $f_{normal}$ will be radiated in a downward-inclined direction.

Figure 4:
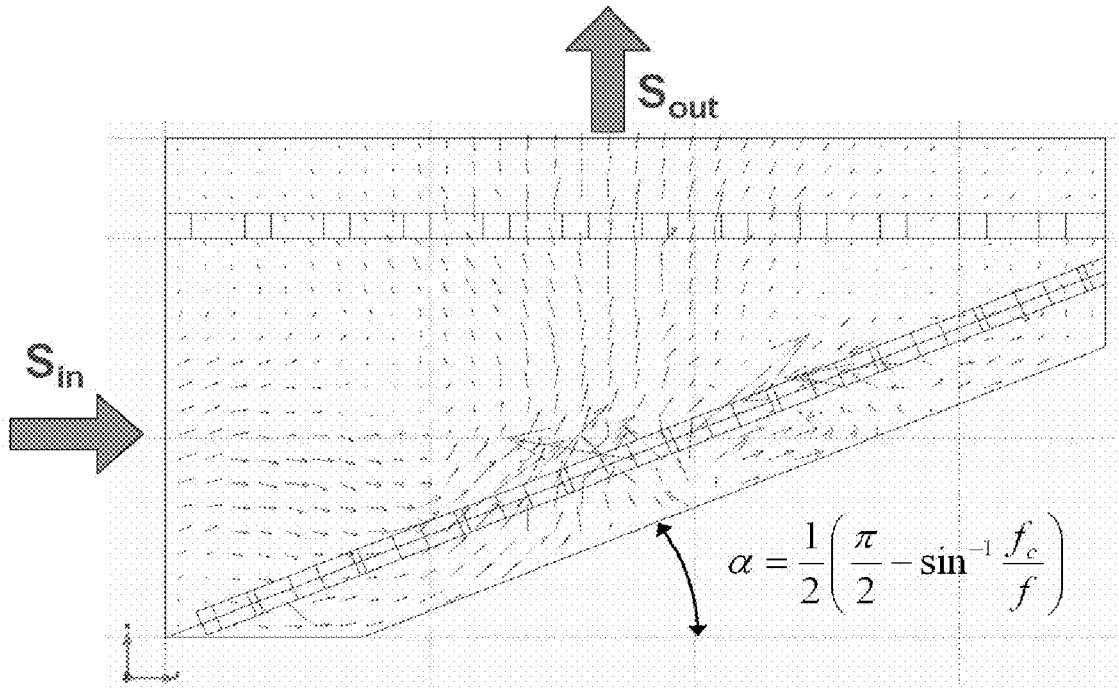
FIG. 4 is a three-dimension finite element numerical model to simulate the operation of the antenna as shown in FIG. 1.

A three-dimensional finite numerical model as shown in FIG. 4 very clearly shows the reflection-angle relationships of the FAWSET antenna indicated in FIG. 3.

In high-power operation, a modified FAWSET antenna can be configured to be filled with dielectric throughout, possibly using a different dielectric material in the twist-reflecting slab region. A rippled-wall dielectric-to-air window outside the trans-reflecting wall would provide a smooth transition and additional resistance to surface breakdown there.

Figure 5:
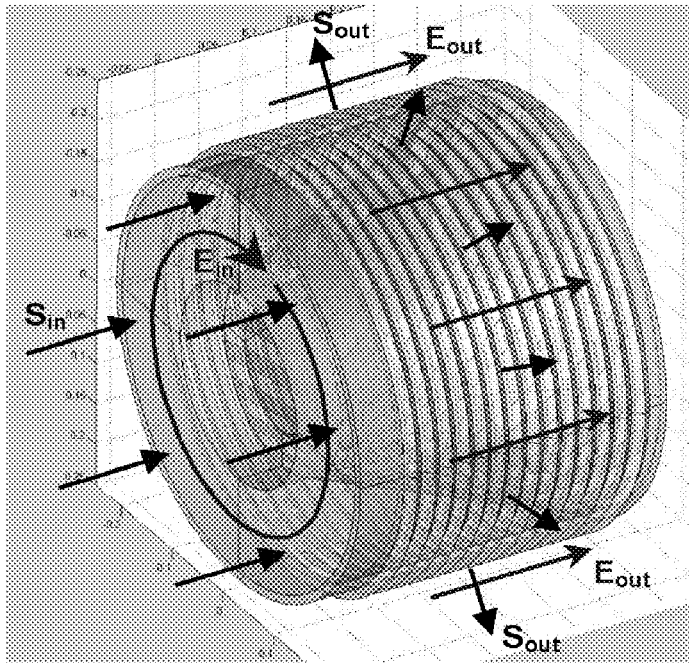
FIG. 5 shows a modification of the antenna as shown in FIG. 1.
Figure 6A:
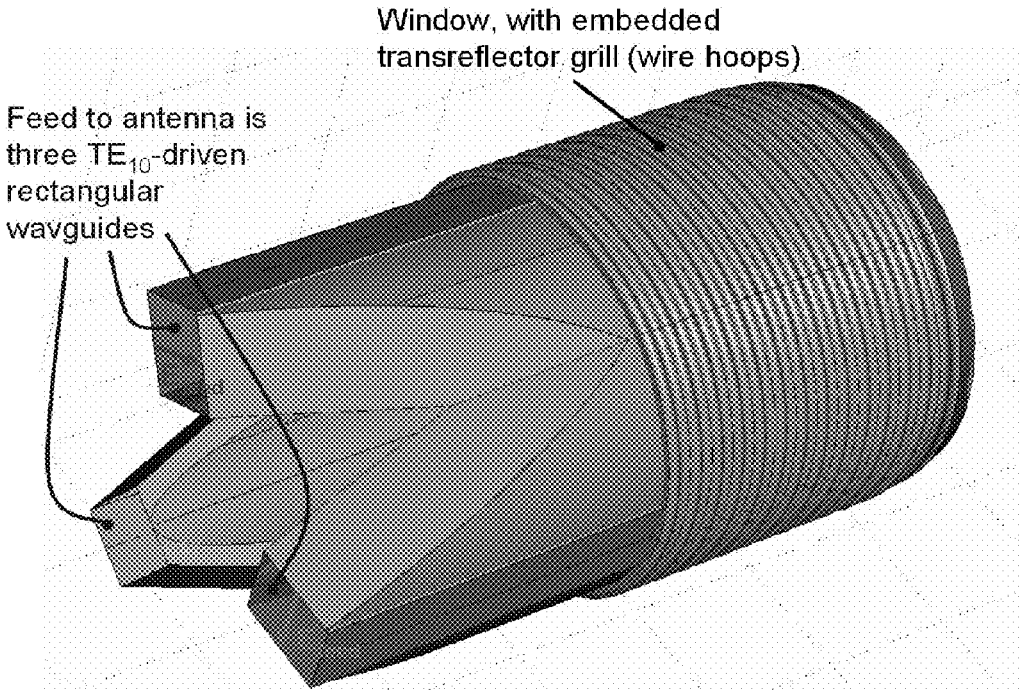
FIG. 6A is a perspective view of the modification as shown in FIG. 5.
Figure 6B:
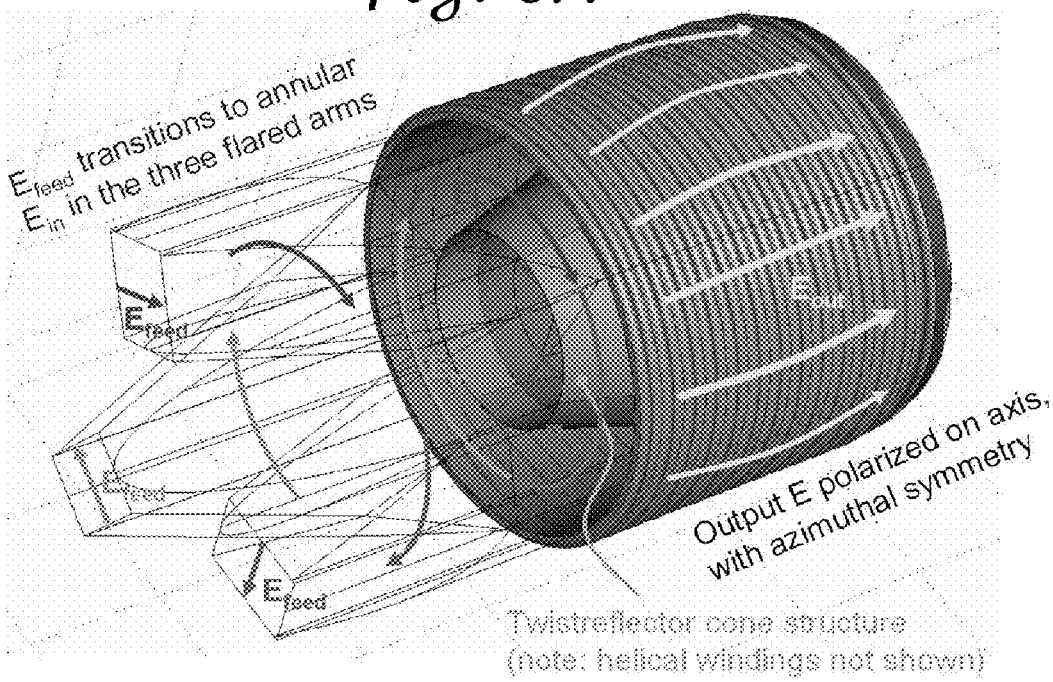
FIG. 6B shows the reshaping of the electric field of the wave as it propagates within the antenna as shown in FIG. 6A.

The operation principle can be extended beyond particular geometric realization of FIG. 1. Referring to FIG. 5, a reshaped FAWSET is proposed for use in cylindrical HPM munitions and/or missiles. As shown, a full-360° azimuthally-continuous input $E_\phi$ is required to feed the antenna. This could be provided by joining multiple output arms from an HPM source as shown in FIG. 6. High-power magnetrons can be operated with multiple waveguide arm outputs suitable for driving this type of antenna. The geometry as shown in FIG. 5 also conveniently eliminates two of the boundary walls from the more box-like FAWSET as shown in FIG. 1 and results in better utilization of both the internal twist-reflecting surface and the radiating aperture.

Figure 7A:
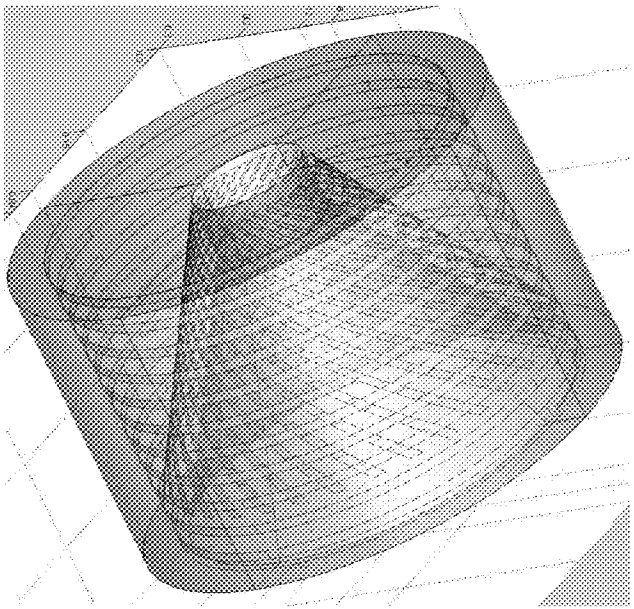
FIGS. 7A to 7C are three-dimensional finite element model simulating operation of the antenna as shown in FIG. 5.
Figure 7B:
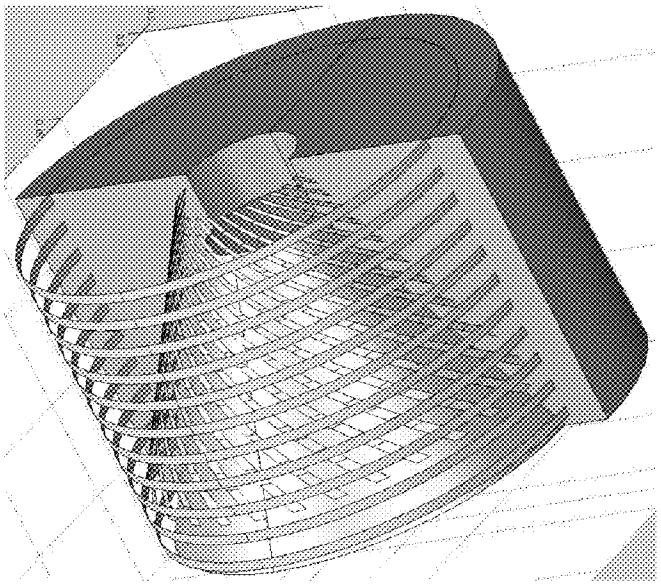
Figure 7C:
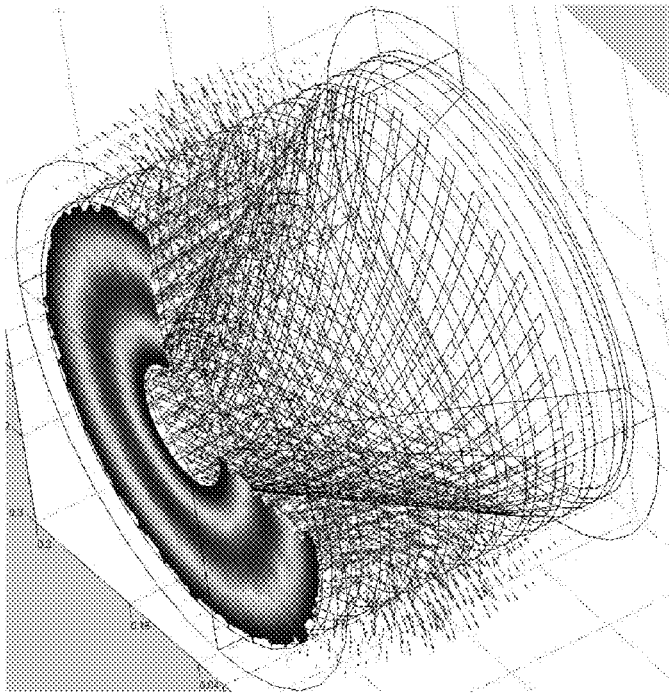

Some results from a three-dimensional finite element model of a full-around 360° cylindrical FAWSET antenna are shown in FIG. 7, which validates the assertion that a cylindrical version of the FAWSET will exhibit the same beneficial wave re-redirecting properties as the easier-to-understand, flat configuration discussed earlier. The redirection of the axially-directed input power into radially-directed output power is very evident in the Poynting vector plot in FIG. 7C.

It will be appreciated that intermediate configurations between the flat and the cylindrical types are possible, and would employ alternative configurations of feeding waveguides.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A flat aperture waveguide sidewall-emitting twist-reflector antenna, comprising:

an E-plane flare;

a twist-reflector extending and tilted from a first sidewall of the E-plane flare;

a trans-reflector extending from a second sidewall of the E-plane flare, wherein:

the twist-reflector and the trans-reflector merge with each other at distal ends thereof with an angle dependent of a frequency of a TE input; and the trans-reflector is substantially transparent to a TE wave reflected from the twist-reflector and reflective to the TE input.

2. A flat aperture waveguide sidewall-emitting twist-reflector antenna, comprising:

a cylindrical twist-reflector;

a plurality of waveguides extending from one end of the cylindrical twist-reflector, wherein each of the waveguides provides a rectangular cross sectional allowing a $TE_{10}$ mode to propagate through; and a plurality of loops forming a trans-reflector surrounding the cylindrical twist-reflector.

* * * * *